US012031437B2

(12) United States Patent
Lu et al.

(10) Patent No.: US 12,031,437 B2
(45) Date of Patent: Jul. 9, 2024

(54) HARD ROCK TUNNEL BORING MACHINE COMBINING MICROWAVE HEATING WITH HIGH PRESSURE WATER CUTTING FOR ASSISTING IN ROCK BREAKING

(71) Applicants: STATE KEY LABORATORY OF SHIELD MACHINE AND BORING TECHNOLOGY, Henan (CN); CHINA RAILWAY TUNNEL GROUP CO., LTD., Guangdong (CN)

(72) Inventors: Gaoming Lu, Henan (CN); Kairong Hong, Henan (CN); Dongjiang Pan, Henan (CN); Jianjun Zhou, Henan (CN); Limeng Zhang, Henan (CN); Yandong Yang, Henan (CN)

(73) Assignees: STATE KEY LABORATORY OF SHIELD MACHINE AND BORING TECHNOLOGY, Henan (CN); CHINA RAILWAY TUNNEL GROUP CO., LTD., Guangdong (CN)

( * ) Notice: Subject to any disclaimer, the term of this patent is extended or adjusted under 35 U.S.C. 154(b) by 206 days.

(21) Appl. No.: 17/781,522

(22) PCT Filed: Jun. 10, 2021

(86) PCT No.: PCT/CN2021/099270
§ 371 (c)(1),
(2) Date: Jun. 1, 2022

(87) PCT Pub. No.: WO2022/236908
PCT Pub. Date: Nov. 17, 2022

(65) Prior Publication Data

US 2023/0080875 A1 Mar. 16, 2023

(30) Foreign Application Priority Data

May 13, 2021 (CN) ..... 202110520401.X

(51) Int. Cl.
*E21D 9/10* (2006.01)
*E21D 9/06* (2006.01)

(52) U.S. Cl.
CPC ..... *E21D 9/1073* (2013.01); *E21D 9/0642* (2016.01); *E21D 9/1006* (2013.01); *E21D 9/1066* (2013.01)

(58) Field of Classification Search
CPC ... E21D 9/1006; E21D 9/1073; E21D 9/1066; E21D 9/0642; E21B 7/15; E21B 7/00; E21C 37/18; E21C 37/00; H05B 6/64
See application file for complete search history.

(56) References Cited

U.S. PATENT DOCUMENTS 9,453,373 B2 * 9/2016 Shnell ..... H05B 6/80
2009/0321132 A1 * 12/2009 Ouellet ..... E21B 7/15 175/11

(Continued)

FOREIGN PATENT DOCUMENTS

CN 112096395 * 12/2020
CN 112196546 * 1/2021

*Primary Examiner* — Carib A Oquendo
(74) *Attorney, Agent, or Firm* — MUNCY, GEISSLER, OLDS & LOWE, P.C.

(57) ABSTRACT

A hard rock tunnel boring machine combining microwave heating with high pressure water cutting for assisting in rock breaking includes a tunnel boring machine body, a microwave heating assisted rock breaking system and a high pressure water cutting assisted rock breaking system, wherein the microwave heating assisted rock breaking system is arranged on the tunnel boring machine body, and is used for heating and cracking a rock; and the high pressure water cutting assisted rock breaking system is arranged on the tunnel boring machine body, and is used for performing hydraulic cutting on the rock. A rock breaking sequence lies in that the microwave heating assisted rock breaking system is used for heating and cracking the rock, then the high (Continued)

pressure water cutting assisted rock breaking system is used for performing hydraulic cutting on the rock, and finally, the tunnel boring machine body is used for squeezing and breaking the rock.

3 Claims, 6 Drawing Sheets

(56) References Cited

U.S. PATENT DOCUMENTS

| | | | | |
|---|---|---|---|---|
| 2019/0040741 | A1* | 2/2019 | Feng | E21C 37/16 |
| 2021/0381315 | A1* | 12/2021 | Allen | E21B 25/04 |

* cited by examiner

HARD ROCK TUNNEL BORING MACHINE COMBINING MICROWAVE HEATING WITH HIGH PRESSURE WATER CUTTING FOR ASSISTING IN ROCK BREAKING

BACKGROUND OF THE INVENTION

1. Field of the Invention

The invention relates to the technical fields of rock and soil and tunneling engineering, and particularly relates to a hard rock tunnel boring machine combining microwave heating with high pressure water cutting for assisting in rock breaking.

2. The Prior Arts

When a tunnel boring machine is used for excavating a hard rock tunnel, severe wear of a mechanical tool is a key engineering problem in the process of hard rock tunnel boring, which will not only increase the maintenance time and maintenance cost, but also easily cause delays in the construction period. Therefore, assisted rock breaking technologies such as high pressure water cutting and microwave heating are gradually introduced into the design of the tunnel boring machine.

For a high pressure water cutting assisted rock breaking technology, the technology is relatively mature and the application fields are relatively wide, and the high pressure water cutting assisted rock breaking technology can be applied to fields such as petroleum, mining, and shale gas exploitation. High pressure water cutting assisted rock breaking has the characteristics of being clean, environment-friendly, low-energy high-efficiency, easy to realize and the like. Studies have shown that the high pressure water cutting assisted rock breaking is used, so that tool cutting mechanical force and thermal stress can be reduced, tool wear can be reduced, tool life can be prolonged, rock breaking performance can be improved, rock breaking efficiency can be improved, and rock breaking cost can be reduced. However, the high pressure water cutting assisted rock breaking technology used at the current stage still has the problem of low rock breaking efficiency.

The microwave heating assisted rock breaking technology has the characteristics of high efficiency, energy saving, selective heating, and the like. Micro and macro cracks can be generated in a rock through microwave heating to reduce rock strength. After the rock strength is reduced, the penetration of a mechanical rock breaking tool can be increased, and the service life of the mechanical rock breaking tool can be prolonged, so that the wear of the mechanical tool can be reduced, the maintenance time of mechanical rock breaking equipment can be reduced, and the rock breaking efficiency can be further improved. However, the current microwave heating assisted rock breaking technology is still in the laboratory stage, can be truly integrated with the tunnel boring machine, and has not been really put into field engineering.

Therefore, in order to further improve the tunneling efficiency of the hard rock tunnel boring machine in field engineering, it is necessary to integrate the high pressure water cutting assisted rock breaking technology with the microwave heating assisted rock breaking technology into the same tunnel boring machine to give a full play to the advantages of the high pressure water cutting assisted rock breaking technology and the microwave heating assisted rock breaking technology.

SUMMARY OF THE INVENTION

In order to solve the problems existing in the prior art, the invention provides a hard rock tunnel boring machine combining microwave heating with high pressure water cutting for assisting in rock breaking. The machine can realize "thermal cycling" combined assisted rock breaking under the combined action of microwave heating and high pressure water cutting, sufficiently exert the advantages of the tunnel boring machine to excavate hard rock tunnels, further reduce mechanical tool wear, and greatly improve the rock breaking efficiency.

In order to realize the above objectives, the hard rock tunnel boring machine combining microwave heating with high pressure water cutting for assisting in rock breaking according to the present invention comprises a tunnel boring machine body, a microwave heating assisted rock breaking system and a high pressure water cutting assisted rock breaking system, wherein the microwave heating assisted rock breaking system is arranged on the tunnel boring machine body, and is used for heating and cracking a rock; and the high pressure water cutting assisted rock breaking system is arranged on the tunnel boring machine body, and is used for performing hydraulic cutting on the rock. A rock breaking sequence lies in that the microwave heating assisted rock breaking system is used for heating and cracking the rock, then the high pressure water cutting assisted rock breaking system is used for performing hydraulic cutting on the rock, and finally, the tunnel boring machine body is used for squeezing and breaking the rock.

The microwave heating assisted rock breaking system comprises a microwave generator, an isolator, a tuner, a first transmission waveguide, a turning waveguide, a rotating waveguide, a first power divider, two second transmission waveguides, two second power dividers, four third transmission waveguides and four microwave heaters, wherein the rotating waveguide is mounted at a center of a cutter head of the tunnel boring machine body, a microwave output end and a microwave input end of the rotating waveguide adopt a coaxial sleeving structure, the microwave output end of the rotating waveguide has a rotating degree of freedom relative to the microwave input end of the rotating waveguide, and the microwave output end of the rotating waveguide is fixedly connected with the cutter head; the microwave generator is fixedly mounted on the main beam of the tunnel boring machine body, and a microwave output end of the microwave generator and the microwave input end of the rotating waveguide are connected sequentially through the isolator, the tuner, the first transmission waveguide and the turning waveguide; the isolator is used for absorbing microwave energy which is not absorbed by the rock and reflected backwards; the tuner is used for automatically matching and adjusting impedance, so that the microwave energy generated by the microwave generator is sufficiently absorbed by the rock; a microwave input end of the first power divider is connected with the microwave output end of the rotating waveguide, a microwave output end of the first power divider is divided into two paths for output, each path is connected with one second transmission waveguide, and one second power divider is connected to a microwave output end of each second transmission waveguide; a microwave input end of each second power divider is connected with the microwave output end of the second transmission waveguide, a microwave output end of each second power divider is divided into two paths for output, each path is connected with one third transmission waveguide, and one microwave heater is connected to a microwave output end of each third transmission waveguide; and the microwave heaters are fixedly embedded in microwave heating through holes in the cutter head, and the microwave output ends of the microwave heaters are right opposite to a surface of the rock.

The high pressure water cutting assisted rock breaking system comprises a high pressure water pressurization device, a first high pressure water pipe, a rotation joint, a divider, four second high pressure water pipes and four high pressure sprinkler heads, wherein the divider is mounted at the center of the cutter head of the tunnel boring machine body, the divider adopts a circular ring structure, the divider concentrically sleeves an outer side of the rotating waveguide, and the divider is fixedly connected with the cutter head; the rotation joint adopts a circular ring structure, and concentrically sleeves the divider, the rotation joint is in rotary sealing connection with the divider, the divider communicates with the rotation joint, and the divider has a rotation degree of freedom relative to the rotation joint; the high pressure water pressurization device is fixedly mounted on the main beam of the tunnel boring machine body, and a water outlet end of the high pressure water pressurization device communicates with a water inlet end of the rotation joint through the first high pressure water pipe; a water outlet end of the divider is divided into four paths for output, each path communicates with one second high pressure water pipe, and one high pressure sprinkler head is connected to a water outlet end of each second high pressure water pipe; and the high pressure sprinkler heads are fixedly embedded in high pressure water spraying through holes in the cutter head, and spraying ends of the high pressure sprinkler heads are right opposite to the surface of the rock.

Each of dash plates is arranged on the cutter head between the microwave heater and the high pressure sprinkler head, each of the high pressure sprinkler heads is adjacent to a hobbing cutter on the cutter head, the microwave heater, the dash plate, the high pressure sprinkler head and the hobbing cutter are arranged on a cutting trajectory of the hobbing cutter in order, and the microwave heater, the dash plate and the high pressure sprinkler head are located in front of the cutting trajectory of the hobbing cutter; and the microwave heaters, the dash plates, the high pressure sprinkler heads and the hobbing cutters are arranged on the cutter head in two arrangement manners. A first arrangement manner lies in that the microwave heater, the dash plate, the high pressure sprinkler head and the hobbing cutter in the cutting trajectory are equal in spacing; and a second arrangement manner lies in that the microwave heaters in the cutting trajectories are arranged in a same diameter direction, and all the high pressure sprinkler heads on the cutting trajectories are arranged in another same diameter direction on the cutter head.

The hard rock tunnel boring machine combining microwave heating with high pressure water cutting for assisting in rock breaking has the following beneficial effects:

The hard rock tunnel boring machine combining microwave heating with high pressure water cutting for assisting in rock breaking according to the present invention can realize "thermal cycling" combined assisted rock breaking under the combined action of microwave heating and high pressure water cutting, sufficiently exert the advantages of the tunnel boring machine to excavate hard rock tunnels, further reduce mechanical tool wear, and greatly improve the rock breaking efficiency.

Figure 1:
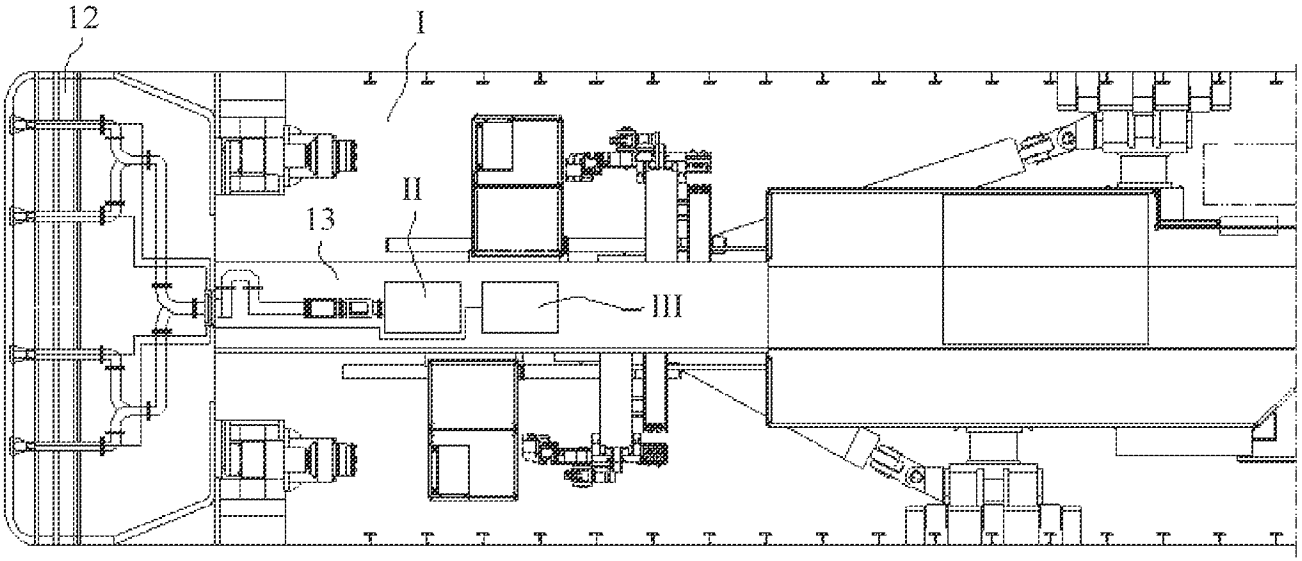
FIG. 1 shows a schematic structural diagram of a hard rock tunnel boring machine combining microwave heating with high pressure water cutting for assisting in rock breaking according to the present invention.

In the drawings, I: tunnel boring machine body, II: microwave heating assisted rock breaking system, III: high pressure water cutting assisted rock breaking system, 1: microwave generator, 2: isolator, 3: tuner, 4: first transmission waveguide, 5: turning waveguide, 6: rotating waveguide, 7: first power divider, 8: second transmission waveguide, 9: second power dividers, 10: third transmission waveguide, 11: microwave heaters, 12: cutter head, 13: main beam, 14: high pressure water pressurization device, 15: first high pressure water pipe, 16: rotation joint, 17: divider, 18: second high pressure water pipe, 19: high pressure sprinkler head, 20: dash plate, and 21: hobbing cutter.

DETAILED DESCRIPTION OF THE PREFERRED EMBODIMENT

The invention will be further described in detail below with reference to the accompanying drawings and specific embodiments.

Figure 2:
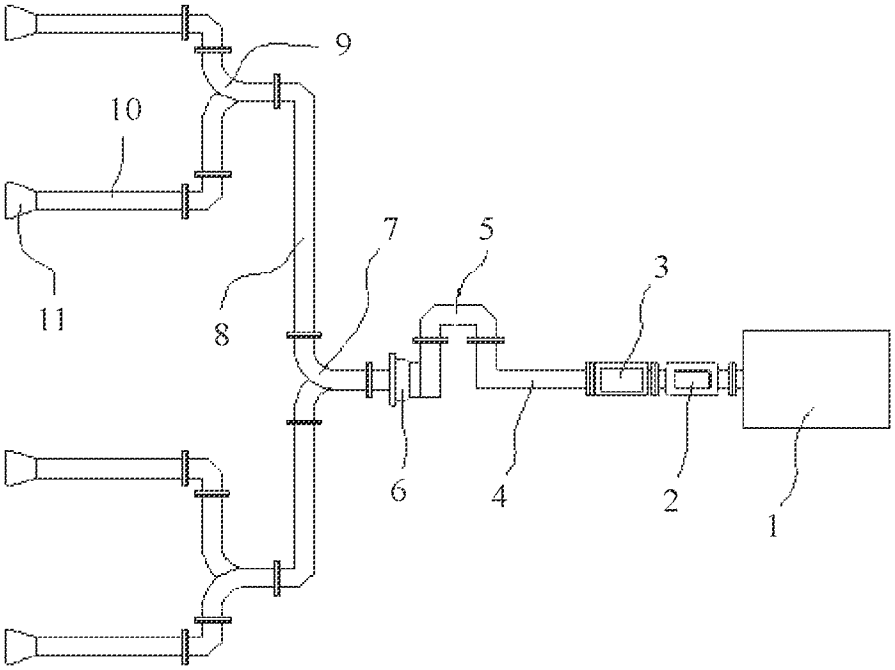
FIG. 2 is a schematic structural diagram of a microwave heating assisted rock breaking system according to the present invention.
Figure 3:
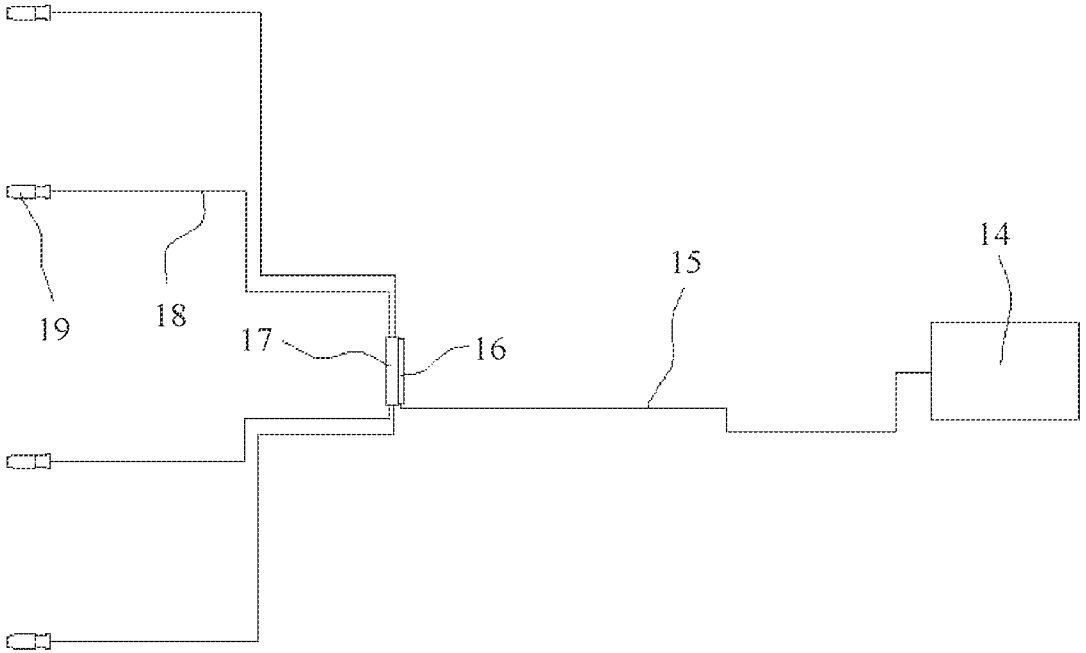
FIG. 3 is a schematic structural diagram of a high pressure water cutting assisted rock breaking system according to the present invention.
Figure 4:
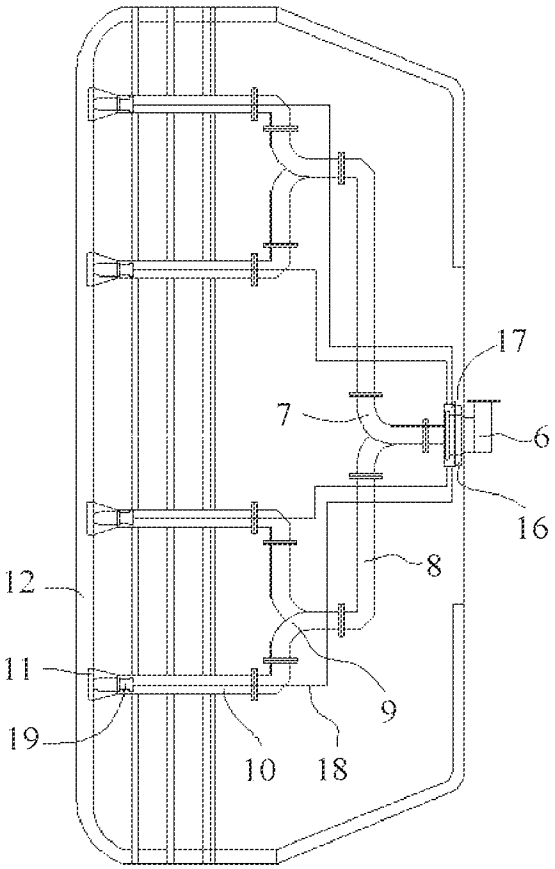
FIG. 4 is a schematic diagram of layout of the microwave heating assisted rock breaking system and the high pressure water cutting assisted rock breaking system in a cutter head according to the present invention.
Figure 5:
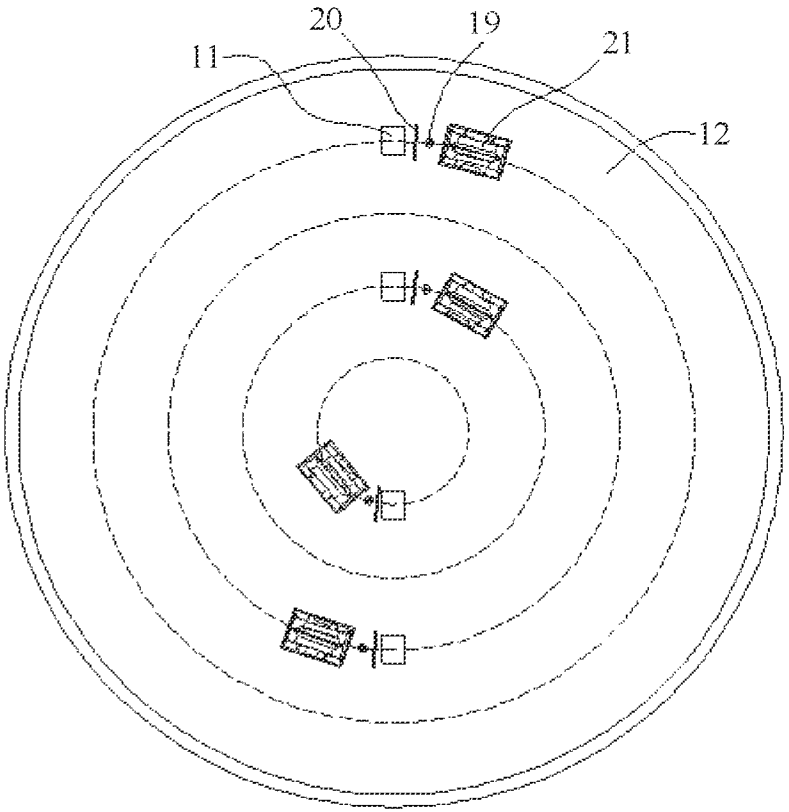
FIG. 5 is a schematic diagram of layout of microwave heaters, dash plates, high pressure sprinkler heads and hobbing cutters on the cutter head according to the present invention (first arrangement manner)
Figure 6:
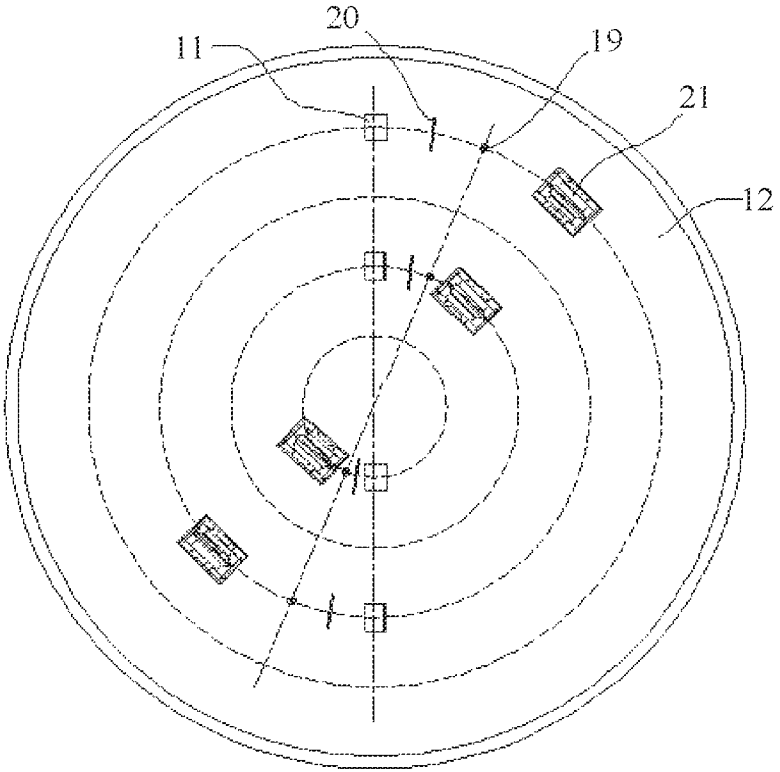
FIG. 6 is a schematic diagram of layout of the microwave heaters, the dash plates, the high pressure sprinkler heads and the hobbing cutters on the cutter head according to the present invention (second arrangement manner).

As shown in FIGS. 1-6, a hard rock tunnel boring machine combining microwave heating with high pressure water cutting for assisting in rock breaking comprises a tunnel boring machine body I, a microwave heating assisted rock breaking system II and a high pressure water cutting assisted rock breaking system III, wherein the microwave heating assisted rock breaking system II is arranged on the tunnel boring machine body I, and is used for heating and cracking a rock; and the high pressure water cutting assisted rock breaking system III is arranged on the tunnel boring machine body I, and is used for performing hydraulic cutting on the rock. A rock breaking sequence lies in that the microwave heating assisted rock breaking system II is used for heating and cracking the rock, then the high pressure water cutting assisted rock breaking system III is used for performing hydraulic cutting on the rock, and finally, the tunnel boring machine body I is used for squeezing and breaking the rock.

The microwave heating assisted rock breaking system II comprises a microwave generator 1, an isolator 2, a tuner 3, a first transmission waveguide 4, a turning waveguide 5, a rotating waveguide 6, a first power divider 7, two second transmission waveguides 8, two second power dividers 9, four third transmission waveguides 10 and four microwave heaters 11; the rotating waveguide 6 is mounted at a center of a cutter head 12 of the tunnel boring machine body I, a microwave output end and a microwave input end of the rotating waveguide 6 adopt a coaxial sleeving structure, the microwave output end of the rotating waveguide 6 has a rotating degree of freedom relative to the microwave input end of the rotating waveguide 6, and the microwave output end of the rotating waveguide 6 is fixedly connected with the cutter head 12; the microwave generator 1 is fixedly mounted on a main beam 13 of the tunnel boring machine body I, a microwave output end of the microwave generator 1 and the microwave input end of the rotating waveguide 6 are connected sequentially through the isolator 2, the tuner 3, the first transmission waveguide 4 and the turning waveguide 5; the isolator 2 is used for absorbing microwave energy which is not absorbed by the rock and reflected backwards; the tuner 3 is used for automatically matching and adjusting impedance, so that the microwave energy generated by the microwave generator 1 is sufficiently absorbed by the rock; a microwave input end of the first power divider 7 is connected with the microwave output end of the rotating waveguide 6, a microwave output end of the first power divider 7 is divided into two paths for output, each path is connected with one second transmission waveguide 8, and one second power divider 9 is connected to a microwave output end of each second transmission waveguide 8; a microwave input end of each second power divider 9 is connected with the microwave output end of the second transmission waveguides 8, a microwave output end of each of the second power dividers 9 is divided into two paths for output, each path is connected with one third transmission waveguide 10, and one microwave heater 11 is connected to a microwave output end of each third transmission waveguide 10; and the microwave heaters 11 are fixedly embedded in microwave heating through holes in the cutter head 12, and the microwave output ends of the microwave heaters 11 are right opposite to the surface of the rock.

The high pressure water cutting assisted rock breaking system III comprises a high pressure water pressurization device 14, a first high pressure water pipe 15, a rotation joint 16, a divider 17, four second high pressure water pipes 18 and four high pressure sprinkler heads 19, wherein the divider 17 is mounted at the center of the cutter head 12 of the tunnel boring machine body I, the divider 17 adopts a circular ring structure, the divider 17 concentrically sleeves an outer side of the rotating waveguide 6, and the divider 17 is fixedly connected with the cutter head 12; the rotation joint 16 adopts a circular ring structure, and concentrically sleeves the divider 17, the rotation joint 16 is in rotary sealing connection with the divider 17, the divider 17 communicates with the rotation joint 16, and the divider 17 has a rotation degree of freedom relative to the rotation joint 16; the high pressure water pressurization device 14 is fixedly mounted on the main beam 13 of the tunnel boring machine body I, and a water outlet end of the high pressure water pressurization device 14 communicates with a water inlet end of the rotation joint 16 through the first high pressure water pipe 15; a water outlet end of the divider 17 is divided into four paths for output, each path communicates with one second high pressure water pipe 18, and one high pressure sprinkler head 19 is connected to a water outlet end of each second high pressure water pipe 18; and the high pressure sprinkler heads 19 are fixedly embedded in a high pressure water spraying through hole in the cutter head 12, and spraying ends of the high pressure sprinkler heads 19 are right opposite to the surface of the rock.

Each of dash plates 20 is arranged on the cutter head 12 between the microwave heater 11 and the high pressure sprinkler head 19, each of the high pressure sprinkler heads 19 is adjacent to a hobbing cutter 21 on the cutter head 12, the microwave heater 11, the dash plate 20, the high pressure sprinkler head 19 and the hobbing cutter 21 are arranged on a cutting trajectory of the hobbing cutter 21 in order, and the microwave heater 11, the dash plate 20 and the high pressure sprinkler head 19 are located in front of the cutting trajectory of the hobbing cutter 21; and the microwave heaters 11, the dash plates 20, the high pressure sprinkler heads 19 and the hobbing cutters 21 are arranged on the cutter head 12 in two arrangement manners. A first arrangement manner lies in that the microwave heater 11, the dash plate 20, the high pressure sprinkler head 19 and the hobbing cutter 21 in the cutting trajectory are equal in spacing; and a second arrangement manner lies in that the microwave heaters 11 in the cutting trajectories are arranged in a same diameter direction on the cutter head 12, and the high pressure sprinkler heads 19 on the cutting trajectories are arranged in another same diameter direction on the cutter head 12.

When the hard rock tunnel boring machine combining microwave heating with high pressure water cutting for assisting in rock breaking is used for digging hard rock tunnels, rotation of the cutter head 12 is firstly controlled. At the same time, the microwave heating assisted rock breaking system II and the high pressure water cutting assisted rock breaking system III are started. The rotating cutter head 12 drives the hobbing cutter 21 to push heading face rock. In the rotation process of the cutter head 12, the heading face rock is heated and cracked by microwave energy outputted by the microwave heaters 11, then hydraulic cutting is realized by a high pressure water jet flow outputted by the high pressure sprinkler heads 19, and finally, the hobbing cutter 21 is used for squeezing and breaking the rock. During the continuous rock breaking process, due to the dash plates 20, high pressure water can be prevented from splashing into the microwave heaters 11, so as to prevent the loss of the microwave energy. In addition, in order to ensure the best microwave heating and cracking effect and hydraulic cutting effect, it is necessary to maintain a certain distance between the microwave heaters 11 and the high pressure sprinkler heads 19 and the heading face rock.

The solutions in the embodiments are not intended to limit the scope of the patent protection, and all equivalent implementations or modifications that do not depart from the invention are included in the scope of this patent.

What is claimed is:

1. A hard rock tunnel boring machine combining microwave heating with high pressure water cutting for assisting in rock breaking, comprising:

a tunnel boring machine body;

a microwave heating assisted rock breaking system; and a high pressure water cutting assisted rock breaking system, wherein the microwave heating assisted rock breaking system is arranged on the tunnel boring machine body, and is used for heating and cracking a rock, wherein the high pressure water cutting assisted rock breaking system is arranged on the tunnel boring machine body, and is used for performing hydraulic cutting on the rock, wherein a rock breaking sequence lies in that the microwave heating assisted rock breaking system is used for heating and cracking the rock, then the high pressure water cutting assisted rock breaking system is used for performing hydraulic cutting on the rock, and finally, the tunnel boring machine body is used for squeezing and breaking the rock, wherein the high pressure water cutting assisted rock breaking system comprises a high pressure water pressurization device, a first high pressure water pipe, a rotation joint, a divider, four second high pressure water pipes and four high pressure sprinkler heads, wherein the divider is mounted at a center of a cutter head of the tunnel boring machine body, the divider adopts a circular ring structure, the divider concentrically sleeves an outer side of a rotating waveguide of the microwave heating assisted rock breaking system, and the divider is fixedly connected with the cutter head, wherein the rotation joint adopts a circular ring structure and concentrically sleeves the divider, the rotation joint is in rotary sealing connection with the divider, the divider communicates with the rotation joint, and the divider has a rotation degree of freedom relative to the rotation joint, wherein the high pressure water pressurization device is fixedly mounted on a main beam of the tunnel boring machine body, and a water outlet end of the high pressure water pressurization device communicates with a water inlet end of the rotation joint through the first high pressure water pipe, wherein a water outlet end of the divider is divided into four paths for output, each path communicates with one second high pressure water pipe, and one high pressure sprinkler head is connected to a water outlet end of each second high pressure water pipe, and wherein the high pressure sprinkler heads are fixedly embedded in high pressure water spraying through holes in the cutter head, and spraying ends of the high pressure sprinkler heads are right opposite to a surface of the rock.

2. The hard rock tunnel boring machine combining microwave heating with high pressure water cutting for assisting in rock breaking according to claim 1, wherein the microwave heating assisted rock breaking system comprises a microwave generator, an isolator, a tuner, a first transmission waveguide, a turning waveguide, the rotating waveguide, a first power divider, two second transmission waveguides, two second power dividers, four third transmission waveguides and four microwave heaters, wherein the rotating waveguide is mounted at the center of the cutter head of the tunnel boring machine body, a microwave output end and a microwave input end of the rotating waveguide adopt a coaxial sleeving structure, the microwave output end of the rotating waveguide has a rotating degree of freedom relative to the microwave input end of the rotating waveguide, and the microwave output end of the rotating waveguide is fixedly connected with the cutter head, wherein the microwave generator is fixedly mounted on the main beam of the tunnel boring machine body, and a microwave output end of the microwave generator and the microwave input end of the rotating waveguide are connected sequentially through the isolator, the tuner, the first transmission waveguide and the turning waveguide, wherein the isolator is used for absorbing microwave energy which is not absorbed by the rock and reflected backwards, wherein the tuner is used for automatically matching and adjusting impedance, so that the microwave energy generated by the microwave generator is sufficiently absorbed by the rock, wherein a microwave input end of the first power divider is connected with the microwave output end of the rotating waveguide, a microwave output end of the first power divider is divided into two paths for output, each path is connected with one second transmission waveguide, and one second power divider is connected to a microwave output end of each second transmission waveguide, wherein a microwave input end of each second power divider is connected with the microwave output end of the second transmission waveguide, a microwave output end of each second power divider is divided into two paths for output, each path is connected with one third transmission waveguide, and one microwave heater is connected to a microwave output end of each third transmission waveguide, and wherein the microwave heaters are fixedly embedded in microwave heating through holes in the cutter head, and microwave output ends of the microwave heaters are right opposite to the surface of the rock.

3. The hard rock tunnel boring machine combining microwave heating with high pressure water cutting for assisting in rock breaking according to claim 2, wherein each of dash plates is arranged on the cutter head between the microwave heater and the high pressure sprinkler head, each of the high pressure sprinkler heads is adjacent to a hobbing cutter on the cutter head, the microwave heater, the dash plate, the high pressure sprinkler head and the hobbing cutter are arranged on a cutting trajectory of the hobbing cutter in order, and the microwave heater, the dash plate and the high pressure sprinkler head are located in front of the cutting trajectory of the hobbing cutter, wherein the microwave heaters, the dash plates, the high pressure sprinkler heads and the hobbing cutters are arranged on the cutter head in one of a first arrangement manner and a second arrangement manner, wherein the first arrangement manner lies in that the microwave heater, the dash plate, the high pressure sprinkler head and the hobbing cutter in the cutting trajectory are equal in spacing, and wherein the second arrangement manner lies in that the microwave heaters in the cutting trajectories are arranged in a same diameter direction, and the high pressure sprinkler heads on the cutting trajectories are arranged in another same diameter direction on the cutter head.

* * * * *